US005675150A

United States Patent [19]

Kunz

[11] Patent Number: 5,675,150

[45] Date of Patent: Oct. 7, 1997

[54] ACTIVE IR INTRUSION DETECTOR

[75] Inventor: Peter Kunz, Gossau, Switzerland

[73] Assignee: Cerberus AG, Mannedorf, Switzerland

[21] Appl. No.: 592,363

[22] PCT Filed: May 19, 1995

[86] PCT No.: PCT/CH95/00112

§ 371 Date: Jan. 30, 1996

§ 102(e) Date: Jan. 30, 1996

[87] PCT Pub. No.: WO95/33248

PCT Pub. Date: Dec. 7, 1995

[30] Foreign Application Priority Data

May 30, 1994 [EP] European Pat. Off. ..... 94108289
Mar. 31, 1995 [CH] Switzerland ..... 907/95

[51] Int. Cl.[6] ..... G08B 13/181

[52] U.S. Cl. ..... 250/341.1; 250/341.8

[58] Field of Search ..... 250/341.1, 341.8

[56] References Cited

U.S. PATENT DOCUMENTS 4,068,222 1/1978 Treviranus ..... 340/556
4,733,081 3/1988 Mizukami ..... 250/341.8

FOREIGN PATENT DOCUMENTS

3045217 A1 7/1982 Germany .
2 176 599 12/1986 United Kingdom .
2 183 825 6/1987 United Kingdom .

*Primary Examiner*—Constantine Hannaher
*Attorney, Agent, or Firm*—Burns, Doane, Swecker & Mathis, LLP

[57] ABSTRACT

The infrared detector contains an emitter (4), a receiver (5) and an analysis circuit (2') for obtaining a working signal (Un). The analysis circuit (2') contains a controller (29) for outputting a compensating signal (Ik) superimposed over the incoming signal (Ie), which on the one hand receives the working signal (Un) and on the other hand is connected to the output of the receiver (5). The compensating signal (Ik) is selected so that the working signal (Un) is corrected to the value zero so that the maximum sensitivity is retained at all times.

38 Claims, 3 Drawing Sheets

Figures 1, 3:
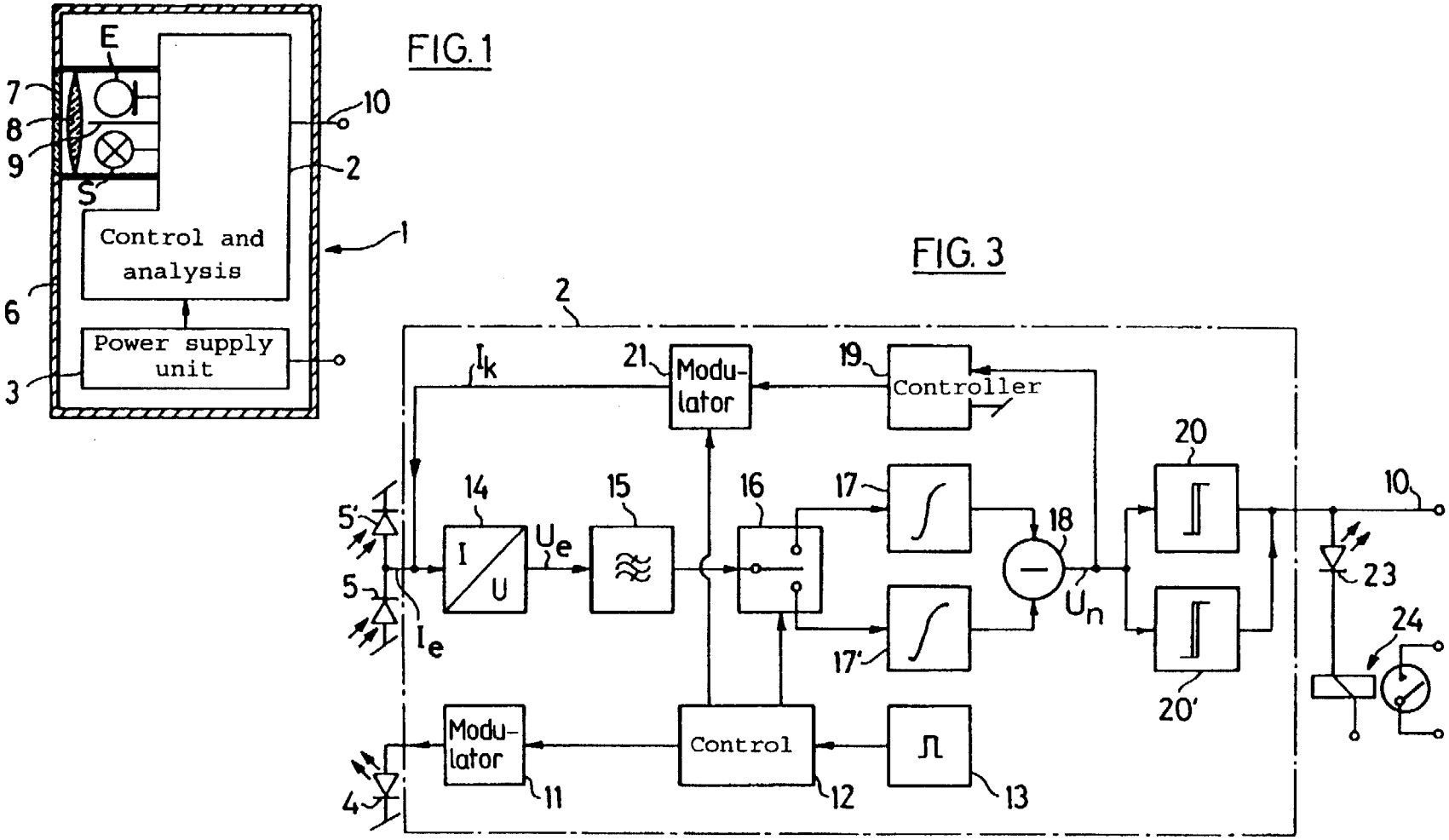

Control and analysis
Power supply unit
E
S

Controller
Modu-lator
Control
Modu-lator
I
U
$U_e$
$I_e$
$I_k$
$U_n$

2'
10
33
μP
26
program control
27
13
30
U
PB
32
U
PB
Differential controller
31
PID controller
29
25
$U_{ref}$
18
$U_n$
17
17'
16
Modulator
21
15
$U_e$
14
I
U
$I_k$
$I_e$
5
11
Modulator
28
7

ACTIVE IR INTRUSION DETECTOR

The present invention lies in the field of infrared detectors, i.e. detectors which monitor a room for unauthorised entry and, to this end, analyse infrared radiation received by the detector. There are two types of such infrared detectors, passive and active.

With the passive infrared detectors, the detector waits until a radiation source, which emits radiation that differs from that of the environment, i.e. the temperature of which is other than that of the environment, enters into the field of vision. The passive infrared detectors, which are relatively low-priced and, today, widespread, can only detect radiating objects on the basis of this principle, and reach a limit as soon as objects, for example valuable objects, are to be monitored, such objects being removable with mechanical, non-detectable means. In addition, with the passive infrared detectors, special measures have to be taken to prevent so-called masking, i.e. the unnoticed changing or covering of the detector's field of vision.

In contrast to the passive detectors, the active infrared detectors do not handle the thermal radiation given off by objects in the field of vision, but rather actively irradiate the room to be monitored and react to changes in the reflected infrared radiation. In this way, they can also detect movements of "dead", i.e. non-radiating, objects. In addition, they can only be masked with considerable difficulty because they detect any approach. In return, the active infrared detectors have certain problems with sensitivity and false alarm reliability, because the reflected infrared radiation can be superimposed with such severe interference that reliable detection of movements becomes impossible in practice.

The invention concerns an active infrared detector for detecting movements in a monitored room, having an emitter for emitting modulated infrared radiation into the monitored room, having a receiver for the infrared radiation reflected from the monitored room and an analysis circuit, connected to the receiver, and containing means for obtaining a working signal.

In a detector of this type described in GB-A-2 183 825, the analysis circuit contains an operational amplifier, designed as a synchronous amplifier, which only amplifies those incoming signals which are in phase with the emitted signal. These signals are integrated in two integrators having various time constants, wherein, in the non-disturbed state, both integrators generate the same voltage, and a difference between these voltages indicates an intruder. These infrared detectors are not satisfactory with respect to reliability of response because the integration of the incoming signal with two different time constants is insufficient guarantee that every movement of an object in the monitored room will actually be identified. The detector is also not reliable with respect to false alarms because the possibility cannot be excluded that a difference between the signals from the integrators is caused by causes other than the movement of an object.

The invention is now intended to improve these known active infrared detectors with respect to sensitivity, reliability and insensitivity towards foreign influences.

The active infrared detector according to the invention for solving the aforementioned problem is characterised in that the analysis circuit has a controller for emitting a compensating signal superimposed over the incoming signal, the controller on the one hand receiving the working signal and on the other hand being connected to the output of the receiver, and that the compensating signal is selected so that the working signal is corrected to the value zero.

Correction of the working signal to the value zero has the advantage that the maximum sensitivity is retained at all times; the receiver therefore works in the same way as a self-balancing scale. The direct result thereof is that an unwanted interference signal, provided that it is of the same frequency and phase as the emitted infrared radiation, is also compensated to zero and does not cause the receiver to be restricted to minimum sensitivity. Interference signals of other frequencies are not so critical because they can be simply filtered out.

A first preferred embodiment of the infrared detector according to the invention is characterised in that a common optical system is provided for the emitter and receiver. The use of a common optical system enables a massive reduction in the manufacturing costs and dimensions, and enables a maximum range to be obtained for a low power consumption.

A second preferred embodiment of the infrared detector according to the invention is characterised in that the analysis circuit has an analogue/digital converter, connected downstream of the controller, the digitised signal being obtainable at one output thereof and the other output thereof being connected to a digital/analogue converter for generating a voltage corresponding to the digital signal value in each case, and characterised in that this voltage is used to generate the compensating signal. Digitisation of the controller signal has the advantage that it enables more differentiated and intelligent signal analysis than used to be the case.

Such signal analysis is possible particularly if, as in a further preferred embodiment of the infrared detector according to the invention, one of the outputs of the analogue/digital converter is connected to a microprocessor. The microprocessor enables, on the one hand, an increase in the resolution and, on the other hand, creates the prerequisite for coupling the sensor present in the infrared detector to a second sensor working according to another detection principal, and analysing the signals of both sensors together.

Figure 2:
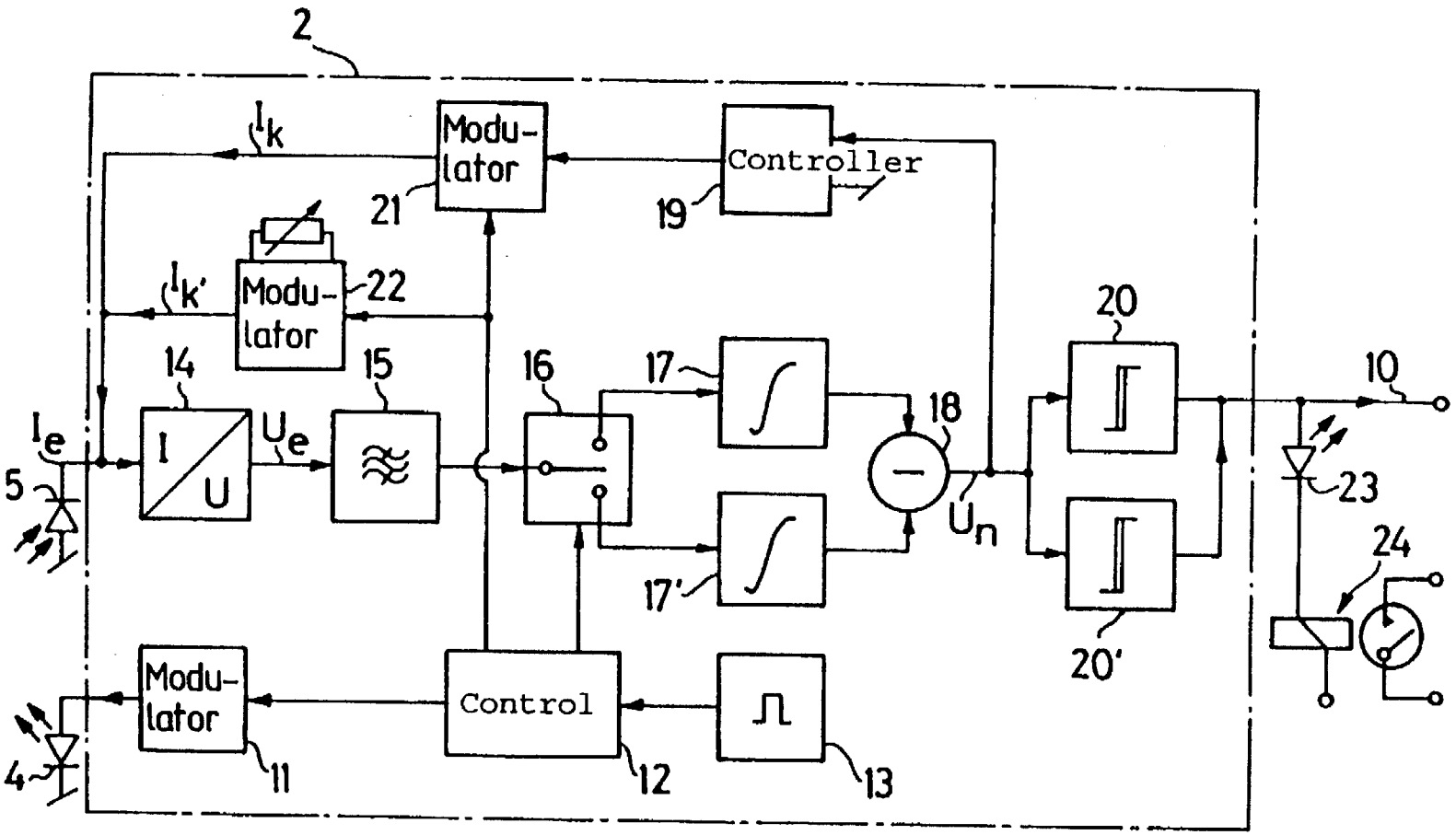
Figure 4:
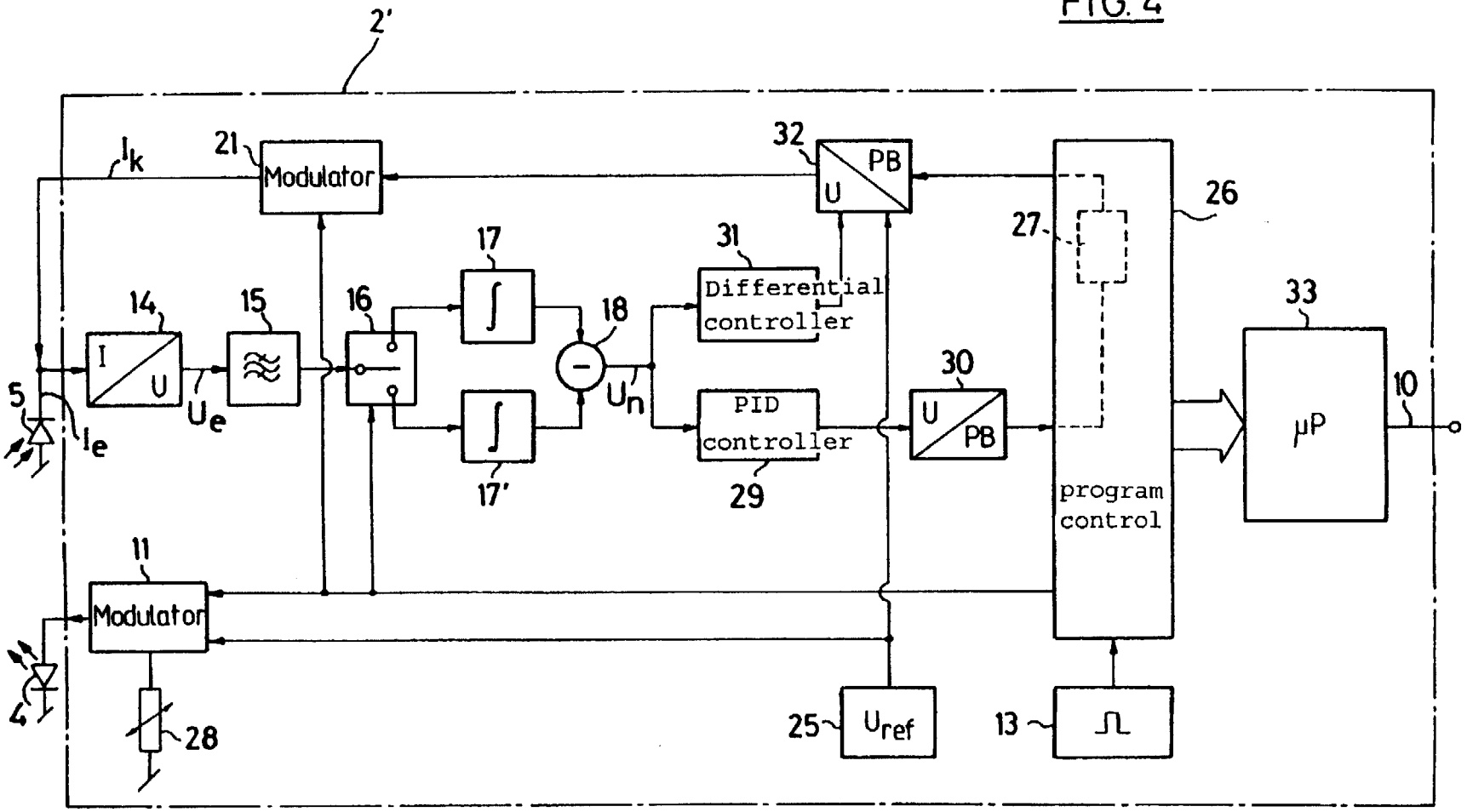

The invention is explained in greater detail below with reference to embodiments illustrated in the drawings, which show:

FIG. 1 a diagrammatic sectional representation of an infrared detector according to the invention, FIG. 2 a block diagram of a first embodiment of the analysis circuit of the infrared detector in FIG. 1, FIG. 3 a detail variant of the circuit in FIG. 2, and FIG. 4 a block diagram of a second embodiment of the analysis circuit of the infrared detector in FIG. 1.

The active infrared movement detector 1 illustrated in FIG. 1 essentially consists of an emitter S, which irradiates the room to be monitored with pulsed infrared light, of a receiver E for the infrared radiation reflected from the monitored room, of an electronic analysis and control circuit 2 and of a power supply unit 3. According to FIGS. 2 and 4, the emitter S is formed by an infrared light-emitting diode (IRED) 4 and the receiver E is formed by a photodiode 5. The emitter S, receiver E, electronic circuit 2 and power supply unit 3 are arranged in a common housing 6, which is mounted in the room to be monitored at a suitable point, for example on a wall or on the ceiling.

The power supply unit 3 is connected to an external power source and contains a fixed voltage regulator (not shown). In the region of the emitter S and the receiver E, the housing 6 contains a window 7 which is permeable to infrared. In addition, a suitable optical system 8 is provided, which naturally need not be arranged between the window 7 on the one hand and the emitter and receiver S and E on the other hand, but rather can be integrated into the window 7. The optical system 8 can be a lens or mirror optical system.

It is essential that a common optical system be provided for the emitter S and receiver E. In other words, this means that the receiver E "looks" into precisely those regions of the monitored room that the emitter S is covering with infrared radiation. This also enables, for the same power consumption, a greatly increased range or, for the same range, a massively reduced power consumption. A screen 9 is arranged between the emitter S and receiver E in order to prevent a direct light connection between these two elements. As can also be seen from FIG. 1, the electronic circuit 2 has an alarm output 10 for the alarm signals obtained from the signal analysis. These alarm signals can activate an internal alarm display incorporated into the detector 1 and/or an external alarm display.

According to FIG. 2, the infrared light-emitting diode 4 is connected upstream of a first modulator 11, by means of which the radiation emitted by the infrared light-emitting diode 4 is suitably modulated. Preferably, this radiation consists of a continuous sequence of pulses and pauses between pulses so that the room to be monitored is irradiated with pulsed infrared light. It may also be sensible to insert a longer, pre-determined emission pause between a sequence of a certain number of pulses and pauses between pulses. In this case, the monitored room is irradiated by pulse trains or pulse packets which are intermittently emitted and interrupted by emission pauses. In this way, the emission pauses can stand in a fixed or variable time ratio to the pulse trains. The first modulator 11 is controlled by a control stage 12, which obtains its clock pulse from a clock pulse generator 13. In particular, the control stage 12 determines the time sequence and the length of the signals output to the infrared light-emitting diode 4.

The infrared radiation emitted by the infrared light-emitting diode 4 is bundled by the optical system 8 (FIG. 1) and directed into a specific region of the monitored room. The infrared radiation reflected from this region is collected by the optical system 8 and routed to the light-sensitive diode 5. From the diode 5, the received infrared radiation is converted into a proportional current (incoming signal) $I_e$ which is supplied to the current/voltage converter 14 connected downstream of the diode 5 and is converted by the current/voltage converter 14 into a voltage (incoming signal) $U_e$. The converter 14 also acts as a kind of filter for uniform light by suppressing light originating from the sun and from the room lighting. In a frequency filter 15 connected downstream of the current/voltage converter 14, unwanted frequencies are filtered out of the incoming signal $U_e$, whereby interference caused by incandescent, fluorescent and discharge lamps, in particular, is suppressed. The output of the frequency filter 15 is connected to a separating filter 16 that is controlled by the control stage 12 in the clock pulse of the infrared light-emitting diode 4 modulation.

The output signal from the frequency filter 15, which is largely free of interference, is supplied via the separating filter 16 alternately to one of two integrators 17, 17'. In this way, the separating filter 16 is controlled by the control stage 12 so that, for the emission duration of the pulses, the incoming signal $U_e$ is routed to one of the integrators, for example to the integrator 17, and, for the duration of the pauses between pulses, the incoming signal $U_e$ is routed to the other integrator, for example the integrator 17'. During any emission pauses between the pulse trains or pulse packets, the separating filter 16 moves into a neutral position in which neither of the two integrators 17 or 17' receives the incoming signal. The separating filter 16 is preferably formed by a controlled switch.

Since the separating filter 16 is controlled in the modulation clock pulse, the integrator 17 only receives the reflected infrared emission signal, including any residues of the filtered interference signal, from the emission pulse period, and the integrator 17' only receives any residues of the filtered interference signal from the period of the pauses between pulses, with the result that the reflected infrared emission signal can be obtained simply by calculating the difference between the output signals from the two integrators 17, 17'. The aforementioned difference calculation takes place in a stage 18 connected downstream of the two integrators 17, 17'. The output signal from this stage 18 is the infrared emission signal $U_n$, reflected from the monitored room and largely freed of interference, which forms the working signal for the signal analysis.

Provided that the conditions in the monitored room remain unchanged, the reflected infrared emission signal will also remain constant. However, if an object moves in the monitored room, regardless of whether the object is a living being, a machine or any other object, then there is a corresponding change in the reflected infrared emission signal. Gaseous materials only influence the reflected signal if the reflection behaviour of the room or room section containing the material concerned changes. This means that simple air movements, such as warm air rising from a space heater, for example, are not detected by the detector and consequently cannot trigger a false alarm, whereas the sudden appearance of vapours or smoke and the like does change the reflection behaviour and is therefore detected by the detector.

The working signal $U_n$ is routed, on the one hand, to a controller 19 and, on the other hand, to two comparators 20 and 20'. The output of the controller 19 is connected to the input of a second modulator 21, the second input of which is connected to the control stage 12 and the output of which is connected to the input of the current/voltage converter 14. The second modulator 21 superimposes a compensating current $I_k$, in phase opposition, over the signal from the photodiode 5, wherein the time conditions for the superimposition of this compensating current are determined by the control stage 12. The controller 19 changes the compensating current $I_k$ until the output signal from the stage 18, i.e. the working signal Un, becomes zero. Thus, the maximum sensitivity is always retained.

The control circuit can be compared to a self-balancing scale or to a bridging circuit, wherein the zero value of the working signal represents the at-rest position. Each infrared signal received, even the unwanted basic signal, is compensated to zero. Only in this way is there the option of using a common optical system 8 for the emitter and receiver S and E (FIG. 1). This is because reflections caused on the emitter side by lenses, mirrors and/or infrared windows, which generally exceed by a power the reflection signal of a possible object in the monitored room, are suppressed by the control circuit. A highly reflective object in the field of vision of the detector does not lead to a loss of sensitivity, but rather is compensated away, and the maximum sensitivity is retained.

The comparators 20 and 20' are used for signal analysis. They compare the working signal $U_n$ with an upper limit value (comparator 20) and a lower limit value (comparator 20') and, if the working signal exceeds upper limit value or falls below the lower limit value, sends an alarm signal to the alarm output 10. Despite the described working signal compensation, this signal analysis can take place because the entire control operation is, in fact, so slow that, even in the event of very careful and slow intrusion into the monitored room, the infrared signal received by the photodiode 5 is not immediately corrected to zero, with the result that both comparators 20, 20' still have sufficient time for detection.

On account of the considerable magnitude of the interference reflections caused by an imperfect optical system 8 or window 9 (FIG. 1), the controller must compensate for a very large amount, generally over 90%, of all the reflections, wherein the interference reflections have a fixed value, determined by the geometry and material of the optical system and window. It would be desirable to equalise this fixed value by means of an additional fixed compensating current $I_k$, which would considerably reduce the amount of the total reflections to be compensated by the controller 19 and considerably increase the resolution. In this case, the controller 19 would have to absorb any deviations caused by production tolerances and/or copy tolerances of the infrared light-emitting diode 4, in addition to the reflections from the monitored room.

As can be seen from FIG. 2, a third modulator 22, also controlled by the control stage 12, is provided for generating the compensating current $I_k$. This is either set to a fixed value for the compensating current $I_k$, or is, as shown in the figure, designed to be adjustable. In the latter case, the compensating current $I_k$, can be adjusted so that the deviations caused by the infrared light-emitting diode 4 are compensated, as well as the aforementioned interference reflections.

The behaviour of the controller 19 is approximately logarithmic. If it requires a certain time t to correct a small change in the working signal, then the correction of a change of ten times the magnitude requires only twice the time 2t. This behaviour is particularly advantageous when the detector is switched on, when the change in the working signal is 100% and the time required for the correction is nevertheless not unnecessarily long.

The alarm signal at the alarm output 10 can be further analysed, for example tested for plausibility, which can take place in the detector or in a control room, or it is routed without further processing to a control room where the alarm is then triggered. The alarm signal can additionally or alternatively activate a light-emitting diode 23 arranged in the detector. According to the illustration, a relay 24 is also provided, the contacts of which enable potential-free analysis of the alarm signal. By separately testing the output signals from the two comparators 20 and 20' for their sign, i.e. by analysing the positive or negative changes in the reflections, the direction of movement of an object in the monitored room can be determined, either at the detector or away from the detector.

FIG. 3 illustrates a further option for suppressing or compensating for unwanted reflections. In this variant, in which a third modulator 22 (FIG. 2) is not required, the photodiode 5 forming the actual movement detector is connected in parallel to a second photodiode 5', preferably having identical data with reversed polarity. In this way, the geometry of the arrangement is selected so that one of the photodiodes 5 is arranged in the focal point of the optical system 8 (FIG. 1) and the second photodiode 5' is arranged outside the focal point. In this way, one of the photodiodes 5 receives the reflected radiation from the monitored room plus any interference reflections, whereas the second photodiode 5' receives only the interference reflections. Thus, the difference between the photoelectric currents of the two photodiodes 5 and 5' corresponds to the desired signal from the monitored room, which can, if necessary, be superimposed by interference signals, such as solar radiation or room lighting.

If two identical photodiodes 5, 5' are used, the temperature coefficients of the photosensitivity are mutually compensated with respect to the common incoming signal. In addition, all those influences and potential sources of interference which act on both photodiodes remain without effect. Influences or interference of this type are, in particular, copy deviations and temperature drifts of the infrared light-emitting diode 4 and copy deviations and changes over time in the reflection constants of the relevant mechanical components, such as varying dyes and surface structures. Thus, the controller 19 and the second modulator 21 simply have to compensate for the infrared signals reflected from the monitored room, whereas around 95% of the total reflections and photoelectric currents are compensated by the second photodiode 5'. In this way, the influence of the controller 19 can be reduced to around ±5%, which increases the resolution of the working signal $U_n$ by a multiple of approximately ten, which corresponds to around ten times the response sensitivity for constant comparator 20, 20' limits.

The aforementioned checking of the alarm signal for plausibility, which is intended to enable false alarms to be suppressed as completely as possible, is particularly meaningful in the so-called dual detectors, i.e. detectors with sensors working according to two different principles. Such known dual passive infrared movement detectors combine the possible infrared radiation with ultrasound or microwaves. In the present active infrared movement detector, a combination of active/passive infrared is feasible. Such a combination would be preferable to the known combinations of infrared/ultrasound and infrared/microwaves, not least because the infrared radiation behaves in exactly the same way as the visible light and is thus controllable with the known optical means on the basis of the visible light. The latter advantageous characteristic of infrared radiation is particularly important, particularly when protecting easily penetrated surfaces with an infrared curtain, for example when protecting pictures or sculptures in galleries or museums, or when protecting entire window surfaces.

The analysis circuit 2' illustrated in FIG. 4 differs from the analysis circuit 2 in FIG. 2 essentially in that another controller is used and that the controller signal is converted from analogue to digital and is thus available for analysis in a digitised form. According to the illustration, in this embodiment, the first modulator 11 is controlled by a program control stage 26 which has, amongst other components, a counter 27. The program control stage 26 receives its clock pulse from a clock pulse encoder 13 and determines the sequence over time and the length of the signals output to the infrared light-emitting diode 4. A temperature sensor for compensating for the response to temperature changes of the control circuit containing the infrared light-emitting diode 4 and the photodiode 5 is designated by reference numeral 28.

The signal processing takes place in a similar manner to that in the analysis circuit illustrated in FIG. 2, up to the stage 18 connected downstream of the two integrators 17 and 17'. The output signal $U_n$ of the stage 18, which forms the working signal for the signal analysis, is supplied to a controller 29, which is preferably a so-called PID controller, i.e. a controller having a proportional, an integral and a differential part, and passes therefrom into a voltage/pulse-width converter 30. This generates, from the analogue output signal from the controller 29, a pulse-shaped signal, in which the total of pulse plus pause between pulses is constant and the width (duration) of the pulse is proportional to the signal from the controller 29. The pulse-shaped signal from the converter 30 enters the program control stage 26, the counter 27 of which counts the clock pulses per width of each of the pulses of this signal. On account of the proportionality between the pulse-width and the output signal from the controller 29, the number of clock pulses per pulse-width determined by the counter 27 represents a digital image of the analogue output signal from the PID controller 29.

The pulse-width obtainable at the output from the voltage/pulse-width converter 30 will only exactly coincide in very rare cases with a multiple of the clock pulse and can vary therefrom by up to ±1 d (d=smallest information unit). The constant length of pulse+pause between pulses is determined by the program control stage 26 and can be approximately 1 ms for a clock frequency of 4 MHz and when using a 12-bit counter. Thus, 1,000 results of up to 12 bits, i.e. 4,096 information units, with a precision of ±1 d plus any converter 30 error, are available every second.

Since the differential part of the signal supplied to the PID controller 29 can lead to a certain instability of the digital signal, it is advantageous to supply this signal part to a differential controller 31. In so doing, the differential part can be divided between the two controllers 29 and 31, or the entire differential part can be routed to the differential controller 31, or the differential controller can also be omitted and only a PID controller 29 used. The essential factor in which of these solutions is selected is, not least, the ratio between cost, on the one hand, and sensitivity and reliability, on the other hand. It should be stressed, however, that all three solutions are fully functional and provide satisfactory results.

The values of the clock pulses determined by the counter 27 pass from the program control stage 26 into a pulse-width/voltage converter 32, in which a voltage corresponding to the counter value is formed, with reference to a reference voltage related to the reference voltage source 25, this voltage determining the compensating current $I_k$. Here, a precision of ±0.001% is achievable without further means, with the result that the compensating current precisely corresponds to the level of the counter 27. The output of the differential controller 31 is also connected to the pulse-width/voltage converter 32 and routes thereto the higher-frequency parts of the working signal $U_n$. The output of the converter 32 is connected to one of the inputs of the second modulator 21 (FIG. 2), the second input of which is connected to the program control stage 26 and the output of which is connected to the input of the current/voltage converter 14.

The second modulator 21 superimposes the compensating current $I_k$, in phase opposition, over the signal from the photodiode 5, wherein the time conditions for this superimposition are determined by the program control stage 26. The PID controller 29 changes its output signal and thus the pulse/pause ratio such that the output signal from the stage 18, i.e. the working signal $U_n$, become equal to zero. Thus, the level of the counter 27 corresponds to the infrared image of the monitored room, up to the aforementioned possible deviation of ±1 d.

Although, in practice, this deviation is of no significance, the precision can be further increased by calculating the mean of a plurality of individual values. Such a mean calculation can, for example, be carried out by the counter 27 or by a microprocessor 33 connected downstream of the program control stage 26. With this, the infrared signal, which is present in the program control stage 26 in a digital form, can be analysed in a more differentiated and intelligent manner, which leads to higher resolution and thus to improved detection reliability and to improved reliability with respect to false messages. In addition, the microprocessor facilitates a meaningful coupling of the described measurement principle with a second measurement principle in a so-called dual detector. The microprocessor 33, which passes the alarm signal, which is present in the form of the result of the analysis, to the alarm output 10, can check the alarm signal for plausibility and thus relieve the burden on the control room.

The described electronic analysis circuit with its control circuit, which is comparable to a bridging circuit in which the zero value of the working signal represents the at-rest position, offers a range of advantages:

- The electronic compensating circuit suppresses the influence of highly reflective objects close to the detector to such an extent that the background radiation is still identifiable. Highly reflective objects are compensated away and the maximum sensitivity is retained.
- The electronic compensating circuit enables the use of a common emission/reception optical system. This is because reflections from lenses, mirrors and/or from the infrared window, caused on the emission side, which exceed by a power the reflection signal of a possible object in the monitored room, are suppressed by the control circuit.
- The digitisation of the signal offers the option of detecting absolute infrared radiation values and thus allowing true presence detection, and enables the use of a microprocessor with all the associated advantages.
- The detection of the absolute infrared radiation value enables the sign thereof to be identified, i.e. identification of whether a positive or negative change in the reflection and thus the movement of an object takes place close to or away from the detector.
- The recommended analogue/digital converter is substantially less expensive than any commercially available A/D converter of the same resolution.

What is claimed is:

1. Active infrared detector for detecting movements in a monitored room, having an emitter for emitting modulated infrared radiation into the monitored room, having a receiver for the infrared radiation reflected from the monitored room, and having an analysis circuit connected to the receiver and containing means for obtaining a working signal, characterised in that the analysis circuit (2, 2') has a controller for outputting a compensating signal ($I_k$) which is superimposed over the incoming signal ($I_e$), which on the one hand receives the working signal ($U_n$) and on the other hand is connected to the output of the receiver (5), and that the compensating signal is selected so that the working signal is corrected to the value zero.

2. Infrared detector according to claim 1, characterised in that a common optical system (8) is provided for the emitter (S, 4) and receiver (E, 5).

3. Infrared detector according to claim 2, characterised in that the analysis circuit (2, 2') has a first modulator (11), connected to a control stage (12, 26), for the pulse-shaped modulation of the signal emitted by the emitter (S, 4), a controlled separating filter (16) connected to the control stage, two integrators (17, 17') connected downstream of the separating filter, and a means (18) for calculating the difference between the output signals of the integrators.

4. Infrared detector according to claim 3, characterised in that the incoming signal ($U_e$) is routed to the integrators (17, 17'), via the separating filter (16), at the clock pulse for the modulation of the emission signal so that integration of the incoming signal over the duration of the pulse takes place in one of the integrators (17), and integration of the incoming signal over the gaps between pulses takes place in the other integrator (17').

5. Infrared detector according to claim 4, characterised in that the means (18) for calculating the difference is connected downstream of at least one comparator (20, 20') in which the working signal ($U_n$) is compared with at least one limit value.

6. Infrared detector according to claim 5, characterised in that two comparators (20, 20') are provided in which the working signal ($U_n$) is compared with an upper and a lower limit value.

7. Infrared detector according to claim 6, characterised in that the output signals from both comparators (20, 20') are tested for their sign in order to determine the direction of movement of an object detected in the monitored room.

8. Infrared detector according to claim 3, characterised in that a second modulator (21), controlled by the control stage (12), is connected downstream of the controller (19), the modulator (21) superimposing, in phase opposition, the compensating signal ($I_k$) over the incoming signal ($I_e$).

9. Infrared detector according to claim 8, characterised in that the control behaviour of the controller (19) is approximately logarithmic.

10. Infrared detector according to claim 8, characterised by a third, modulator (22) for generating an additional compensating signal ($I_{k'}$) for compensating for reflections caused by the optical system (8) or by an infrared-permeable window (7) of the detector (1).

11. Infrared detector according to claim 8, characterised in that the receiver is formed by a first diode and that a second diode with identical data is connected, with reverse polarity, in parallel to the first diode, and that the difference between the photoelectric currents of the two diodes forms the incoming signal (Ie).

12. Infrared detector according to claim 11, characterised in that the first diode (5) receives the infrared radiation reflected from the monitored room and the interference radiation optionally reflected by the optical system (8) or by an infrared-permeable window (7) of the detector (1), and that the second diode (5') only receives the aforementioned interference radiation.

13. Infrared detector according to claim 12, characterised in that the first diode (5) is arranged in the focal point of the common optical system (8) and the second diode (5') is arranged outside the focal point.

14. Infrared detector according to claim 1, characterised in that the analysis circuit (2') has an analogue/digital converter (26, 30) connected downstream of the controller (29), at one of the outputs of which the digitised controller signal is obtainable and the other output of which is connected to a digital/analogue converter (25, 32) for generating a voltage corresponding to the digital signal value in each case, and that this voltage is used to generate the compensating signal ($I_k$).

15. Infrared detector according to claim 14, characterised in that one of the outputs of the analogue/digital converter (26, 30) is connected to a microprocessor (33).

16. Infrared detector according to claim 15, characterised in that the controller (29) receiving the working signal ($U_n$) is formed by a PID controller.

17. Infrared detector according to claim 16, characterised in that the working signal ($U_n$) is routed, in parallel to the PID controller (29), to a differential controller (31) for the differential part of the signal, and that the output of the differential controller is connected to the pulse-width/voltage converter (32).

18. Infrared detector according to claim 14 characterised in that the analogue/digital converter is formed by a signal converter (30) for converting the controller signal into a pulse-shaped signal and by a stage (26), connected downstream of the signal converter, for obtaining numerical values corresponding the magnitude of the individual pulses.

19. Infrared detector according to claim 18, characterised in that the signal converter (30) is formed by a voltage/pulse-width converter which generates a pulse-shaped signal from the analogue output signal from the controller, in which the pulse plus pause between pulses is constant and the width of the pulse is proportional to the controller signal.

20. Infrared detector according to claim 19, characterised in that the stage (26) connected downstream of the signal converter (30) has a counter (27) and a clock pulse encoder (13), wherein clock pulses corresponding to the width of the individual signal pulses are counted by the counter.

21. Infrared detector according to claim 20, characterised in that the digital/analogue converter is formed by a pulse-width/voltage converter (32) connected to a reference voltage source (25), each value of the counter (27) being converted into a voltage in the pulse-width/voltage converter (32).

22. Apparatus for detecting movements in a monitored space, comprising an infrared radiation emitter for emitting modulated infrared radiation into the monitored space, a receiver for receiving infrared radiation reflected from the monitored space and producing a corresponding incoming signal; a circuit for receiving said incoming signal and producing a working signal; and a compensation signal generator connected to said circuit for receiving said working signal and producing a compensating signal for adjusting said incoming signal so that said working signal is corrected substantially to zero to maximize the sensitivity of the apparatus.

23. Apparatus according to claim 22, including a common optical system for radiation from said emitter and to said receive.

24. Apparatus according to claim 22 for detecting movements in a monitored space, comprising a common optical system for radiation passing from said infrared radiation emitter into the monitored space and for radiation passing from said monitored space to said receiver.

25. Apparatus according to claim 22 for detecting movements in a monitored space, comprising an analysis circuit having a first modulator, a control unit connected to said first modulator for modulating the pulse shape of the radiation emitted by said emitter, a separating filter having an input connected to said control unit, first and second integrators each having an input connected to said separating filter, and means for calculating the difference between the output signals from said integrators.

26. Apparatus according to claim 25, wherein said control unit receives clock pulses for modulating the emissions from said emitter, and wherein clock pulses are routed also through said separating filter to said first and second integrators so that integration of a signal incoming from said receiver takes place in said first integrator during the pulse and takes place in said second integrator during the gaps between pulses.

27. Apparatus according to claim 26, wherein said means for calculating the difference is connected downstream of at least one comparator in which a working signal is compared with at least one limit value.

28. Apparatus according to claim 27, wherein two of said comparators are provided, one for comparing the working signal with an upper limit and one for comparing the working signal with a lower limit.

29. Apparatus according to claim 25, including a controller and a second modulator connected to receive inputs from both said controller and said control unit, said second modulator superimposing in phase opposition a compensating signal over the incoming signal from said receiver.

30. Apparatus according to claim 29, additionally including means for generating an additional compensating signal to compensate for incoming radiation attributable to reflections from parts of the apparatus.

31. Apparatus according to claim 22, including an analysis circuit having an analogue/digital converter for producing a digitized controller signal, a controller connected to one output of said analogue/digital converter and a digital/analogue converter connected to another output of said analogue/digital converter, said analogue/digital converter generating a voltage corresponding to the digital signal value, and means for generating a compensating signal from such voltage.

32. Apparatus according to claim 31, wherein said controller is formed by a microprocessor.

33. Apparatus according to claim 32, wherein said analogue/digital converter is formed by a signal converter for convening the controller signal into a pulse-shaped signal and wherein a unit downstream of the signal converter produces numerical values corresponding to the magnitude of the individual pulses.

34. Apparatus according to claim 33, wherein said signal converter is formed by a voltage/pulse-width converter which generates a pulse-shaped signal from an analogue output signal from the controller, in which the pulse plus the pause between pulses is constant and the width of the pulse is proportional to the controller signal.

35. Apparatus according to claim 34, wherein said unit connected downstream of the signal converter has a counter and a clock pulse encoder, and wherein clock pulses corresponding to the width of the individual signal pulses are counted by the counter.

36. Apparatus according to claim 35, wherein said digital/analogue converter is formed by a pulse-width/voltage converter connected to a reference voltage source, and wherein each value of said counter is converted into a voltage in the pulse-width/voltage converter.

37. Apparatus for monitoring a space, comprising an infrared emitter for emitting modulated radiation into the monitored space, means for receiving infrared radiation from the monitored space and producing corresponding incoming signals; and means for producing signals for balancing said incoming signals substantially to zero to maximize the sensitivity of the apparatus.

38. Apparatus for monitoring a space according to claim 37, including a common optical system for radiation passing from said emitter and for radiation passing to said means for receiving radiation.

* * * * *